US005614665A

United States Patent [19]

Curran et al.

[11] Patent Number: 5,614,665

[45] Date of Patent: Mar. 25, 1997

[54] METHOD AND SYSTEM FOR MONITORING AN EVAPORATIVE PURGE SYSTEM

[75] Inventors: Patrick J. Curran, Farmington Hills; Juliette J. McCoy, South Lyon; Michael A. Panganis, Plymouth; David C. Waskiewicz, Novi; Bryce A. Schwager, Ypsilanti; Edward G. Rychlick, Dearborn, all of Mich.

[73] Assignee: Ford Motor Company, Dearborn, Mich.

[21] Appl. No.: 515,844

[22] Filed: Aug. 16, 1995

[51] Int. Cl.[6] ..... F02M 33/02

[52] U.S. Cl. ..... 73/118.1; 123/521

[58] Field of Search ..... 73/23.31, 23.32, 73/112, 113, 116, 117.2, 117.3, 118.1; 123/672, 520, 521, 568, 571

[56] References Cited

U.S. PATENT DOCUMENTS

| | | | |
|---|---|---|---|
| 5,261,379 | 11/1993 | Lipinski et al. | 123/520 |
| 5,263,462 | 11/1993 | Reddy | 123/520 |
| 5,275,144 | 1/1994 | Gross | 73/118.1 |
| 5,295,472 | 3/1994 | Otsuka et al. | 123/520 |
| 5,299,545 | 4/1994 | Kuroda et al. | 123/520 |
| 5,333,589 | 8/1994 | Otsuka | 123/520 |
| 5,333,590 | 8/1994 | Thomson | 123/520 |
| 5,353,771 | 10/1994 | Blumenstock et al. | 123/520 |
| 5,355,863 | 10/1994 | Yamanaka et al. | 123/520 |
| 5,363,828 | 11/1994 | Yamashita et al. | 123/520 |
| 5,373,822 | 12/1994 | Thompson | 73/861.01 |
| 5,474,049 | 12/1995 | Nagaishi et al. | 73/580 |
| 5,495,749 | 3/1996 | Dawson et al. | 73/118.1 |

*Primary Examiner*—Richard Chilcot
*Assistant Examiner*—Eric S. McCall
*Attorney, Agent, or Firm*—Peter Abolins; Roger L. May

[57] ABSTRACT

A method and system for monitoring an evaporative purge system for malfunctions and leaks. First, a plurality of predetermined entry conditions are checked for satisfaction. If the plurality of predetermined entry conditions have been met, a flow of vapor in the evaporative purge system is determined. The evaporative purge system is then sealed from atmosphere so as to pull a vacuum on the fuel tank. The vacuum is compared to a predetermined vacuum range. If the vacuum is within the predetermined vacuum range, the vacuum is allowed to stabilize to obtain a stabilized vacuum level. A decrease in the stabilized vacuum level is determined after a predetermined amount of time to obtain a vacuum bleed-up. A vacuum bleed-up acceptance threshold is then determined based on the determined flow of vapor and the vacuum bleed-up is then compared to the vacuum bleed-up acceptance threshold. If the vacuum bleed-up exceeds the vacuum bleed-up acceptance threshold, atmosphere is provided to the evaporative purge system until stabilization. The evaporative purge system is then sealed again to create a pressure build. The pressure build is compared to a pressure threshold. Finally, a malfunction signal is generated if the pressure build is less than the pressure threshold.

19 Claims, 7 Drawing Sheets

METHOD AND SYSTEM FOR MONITORING AN EVAPORATIVE PURGE SYSTEM

TECHNICAL FIELD

This invention relates to a method and system for monitoring an evaporative purge system in a vehicle having a fuel tank connected to an internal combustion engine for the purpose of determining whether the purge system is functioning properly.

BACKGROUND ART

Evaporative emission control systems are widely used in internal combustion engine powered motor vehicles to prevent evaporative fuel, i.e., fuel vapor, from being emitted from the fuel tank into the atmosphere. There are generally three main components that control such evaporative emission operations: vapor control/rollover valves, vapor management valves and fuel carbon canister(s). One or more of the above components may typically be found in an internal combustion engine powered motor vehicle to control evaporative emission.

In the event that one or more of the above evaporative emission control components malfunction, fuel vapors may be vented improperly resulting in reduced engine performance and possible release of vapors into the atmosphere. It is thus desirable to employ an on-board diagnostic system capable of detecting malfunctions and leaks in the evaporative purge system so that corrective measures may be taken.

Various techniques for monitoring the evaporative purge system are known. For example, see U.S. Pat. Nos. 5,261,379, 5,263,462, 5,275,144, 5,295,472, 5,299,545, 5,333,589, 5,333,590, 5,353,771, 5,355,863, and 5,363,828. However, the known prior art fails to disclose a method and system for monitoring the evaporative purge system in a significantly reduced amount of time and in a way in which false failure indications are eliminated.

DISCLOSURE OF THE INVENTION

It is thus a general object of the present invention to overcome the limitations of the prior art by providing a method and system for accurately monitoring the evaporative purge system of an internal combustion engine powered motor vehicle for malfunctions and leaks in the purge system.

In carrying out the above objects and other objects, features and advantages, of the present invention, a method is provided for monitoring the evaporative purge system for malfunctions and leaks. The method includes the initial step of determining whether a plurality of predetermined entry conditions have been met. The method also includes the step of determining a flow of vapor in the evaporative purge system if the plurality of predetermined entry conditions have been met. The method further includes the steps of sealing the evaporative purge system from atmosphere so as to pull an initial vacuum on the fuel tank and determining whether the initial vacuum is within a predetermined vacuum range. The method also includes the step of allowing the initial vacuum to stabilize to obtain a stabilized vacuum level if the initial vacuum is within the predetermined vacuum range. The method still further includes the step of determining a rise in the stabilized vacuum level after a predetermined amount of time to obtain a vacuum bleed-up. A vacuum bleed-up acceptance threshold is determined based on the determined flow of vapor. Next, the method includes the steps of comparing the vacuum bleed-up with the vacuum bleed-up acceptance threshold and providing atmospheric pressure to the evaporative purge system if the vacuum bleed-up exceeds the vacuum bleed-up acceptance threshold. The method continues with the steps of sealing the evaporative purge system from atmosphere to create a pressure build and comparing the pressure build to a pressure threshold. The method concludes with the step of generating a malfunction signal if the pressure build is less than the pressure threshold.

In further carrying out the above objects and other objects, features and advantages, of the present invention, a system is also provided for carrying out the steps of the above described method. The system includes a vapor management valve interposed between an intake manifold of the internal combustion engine, fuel tank and an evaporation canister for pulling a vacuum on the fuel tank and the evaporation canister. The system also includes a canister vent valve interposed between atmosphere and the evaporation canister for sealing the evaporative purge system from atmosphere. The system further includes a pressure transducer coupled to the fuel tank for sensing the vacuum in the fuel tank. Still further, the system includes an electronic engine control (EEC) assembly, in electrical communication with the vapor management valve, the canister vent valve and the pressure transducer, as means for determining whether a plurality of predetermined entry conditions have been met and means for determining a flow of vapor in the evaporative purge system. The EEC assembly is also provided as means for determining whether the sensed vacuum is within a predetermined vacuum range. The EEC assembly is further provided as means for allowing the sensed vacuum to stabilize to obtain a stabilized vacuum level and as means for determining a rise in the stabilized vacuum level after a predetermined amount of time to obtain a vacuum bleed-up. Still further, the EEC assembly is provided as means for determining a vacuum bleed-up acceptance threshold based on the determined flow of vapor and as means for comparing the vacuum bleed-up with the vacuum bleed-up acceptance threshold. The EEC assembly is also provided as means for comparing a pressure build to a pressure threshold and for generating a malfunction signal if the pressure build is less than the pressure threshold.

The above objects and other objects, features and advantages of the present invention are readily apparent from the following detailed description of the best mode for carrying out the invention when taken in connection with the accompanying drawings.

BRIEF DESCRIPTION OF THE DRAWINGS

FIGS. 2*a*–2*d* are flow diagrams illustrating the general sequence of steps associated with the operation of the present invention;

BEST MODES FOR CARRYING OUT THE INVENTION

Figure 1:
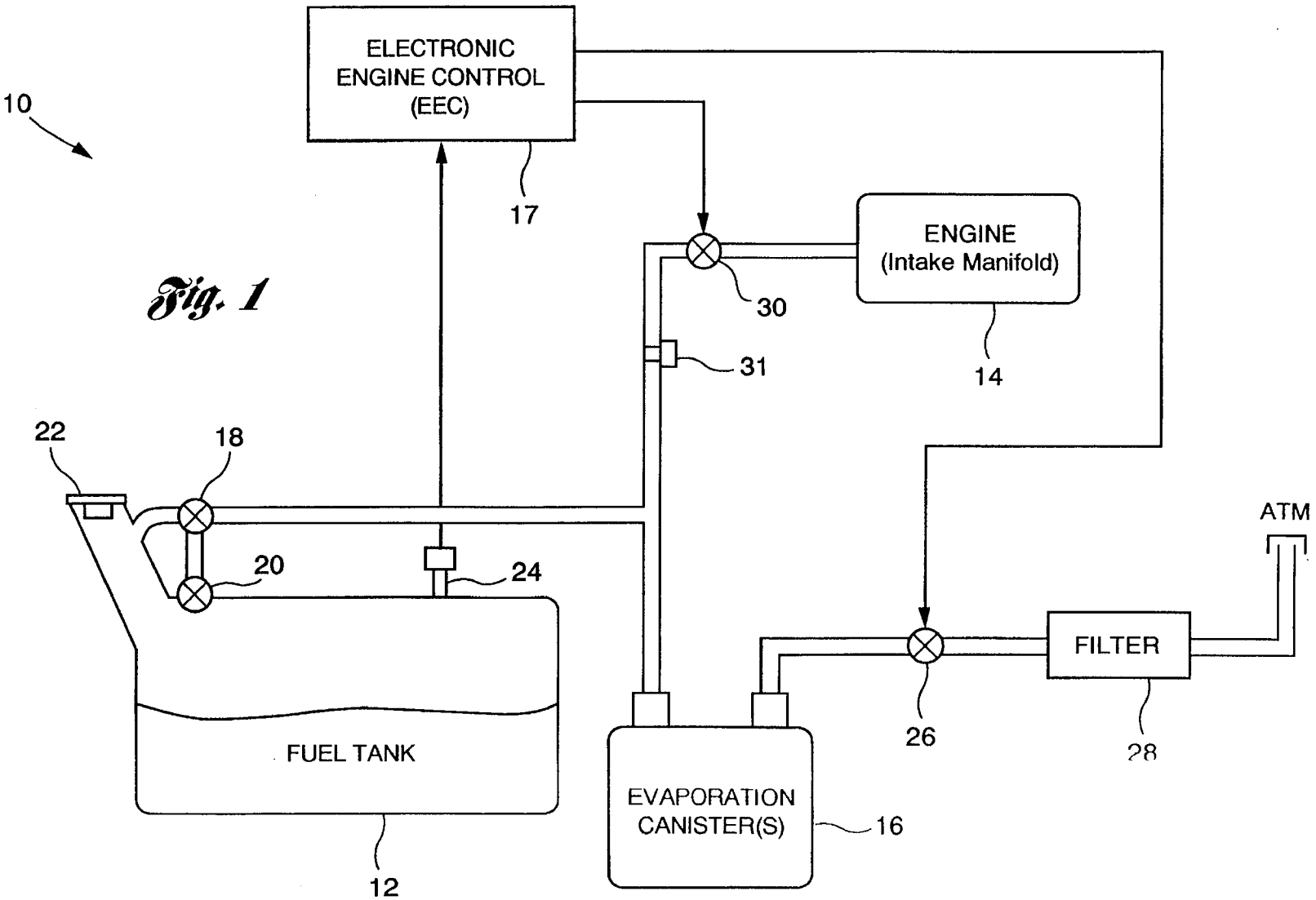
FIG. 1 is a schematic diagram of the preferred embodiment of the present invention.
Figure 2A:
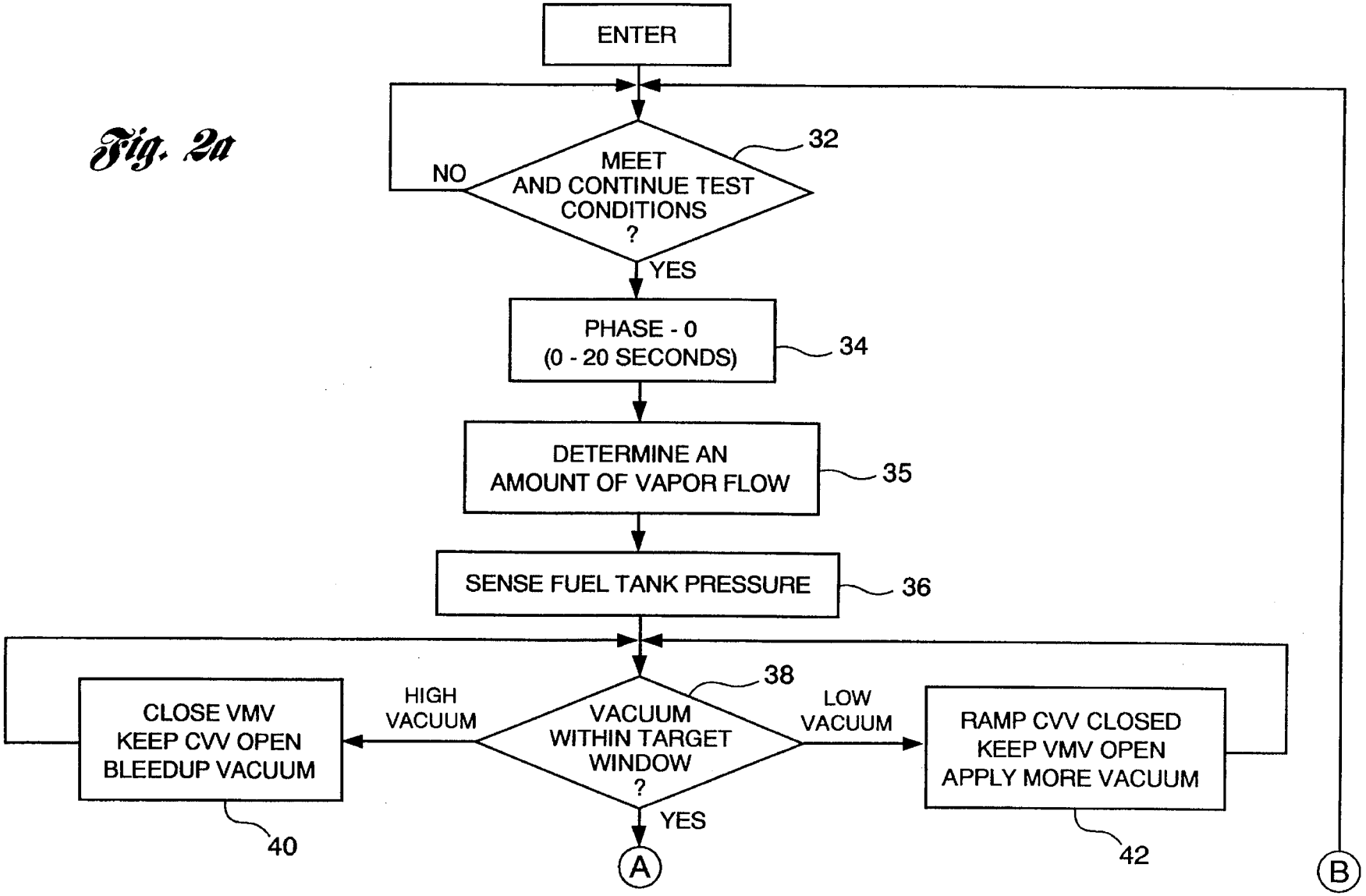
Figure 2B:
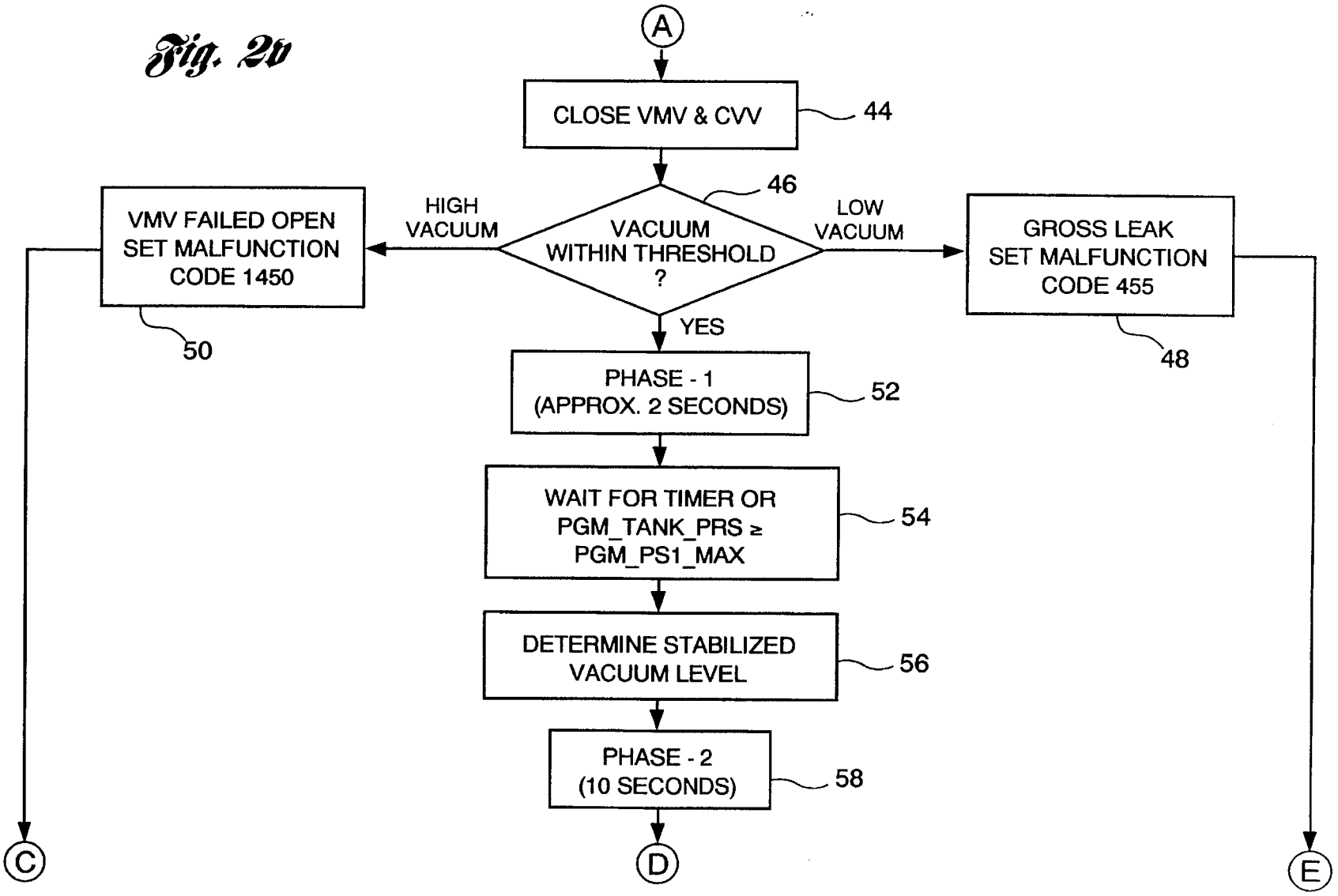
Figure 2C:
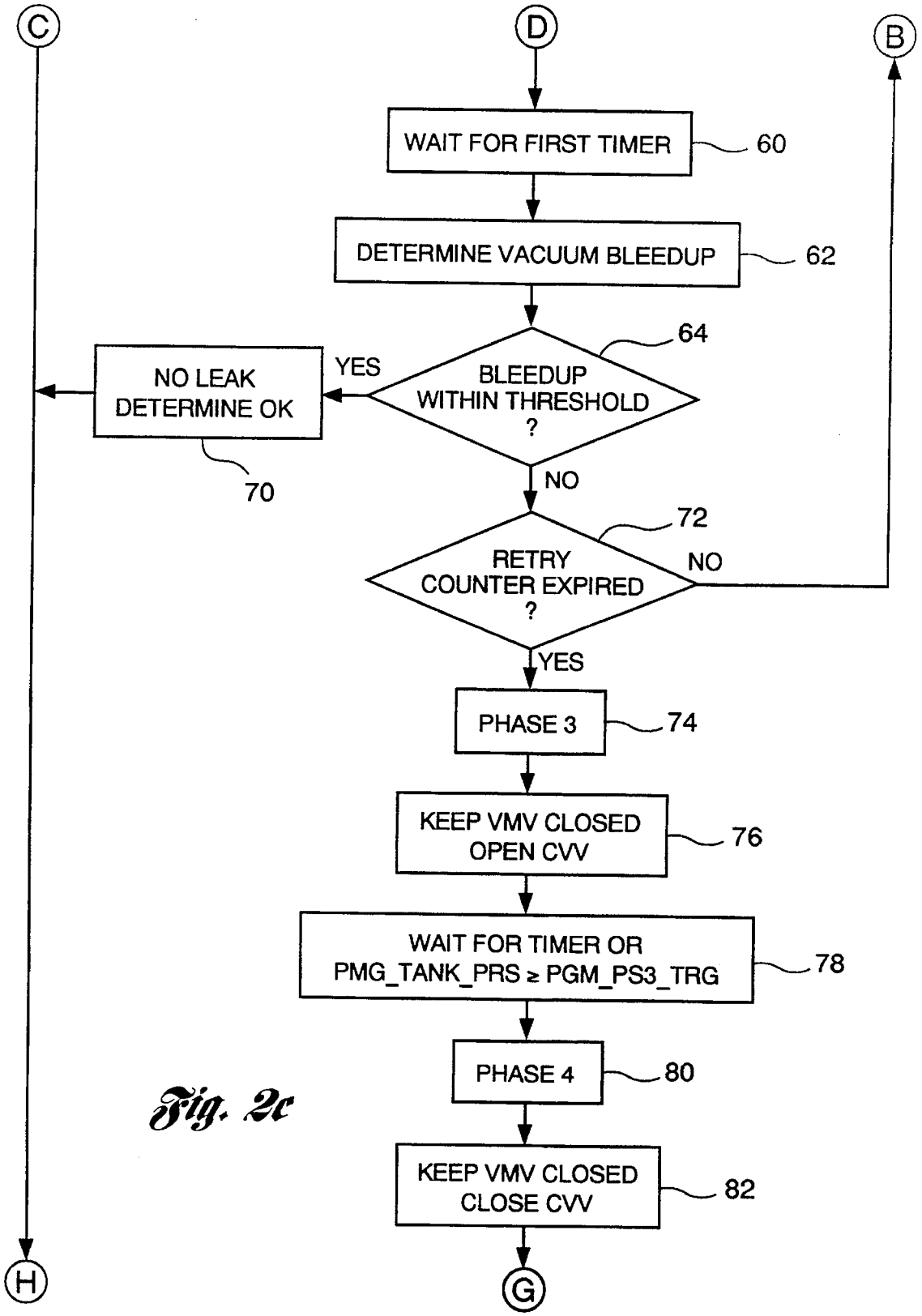
Figure 2B:
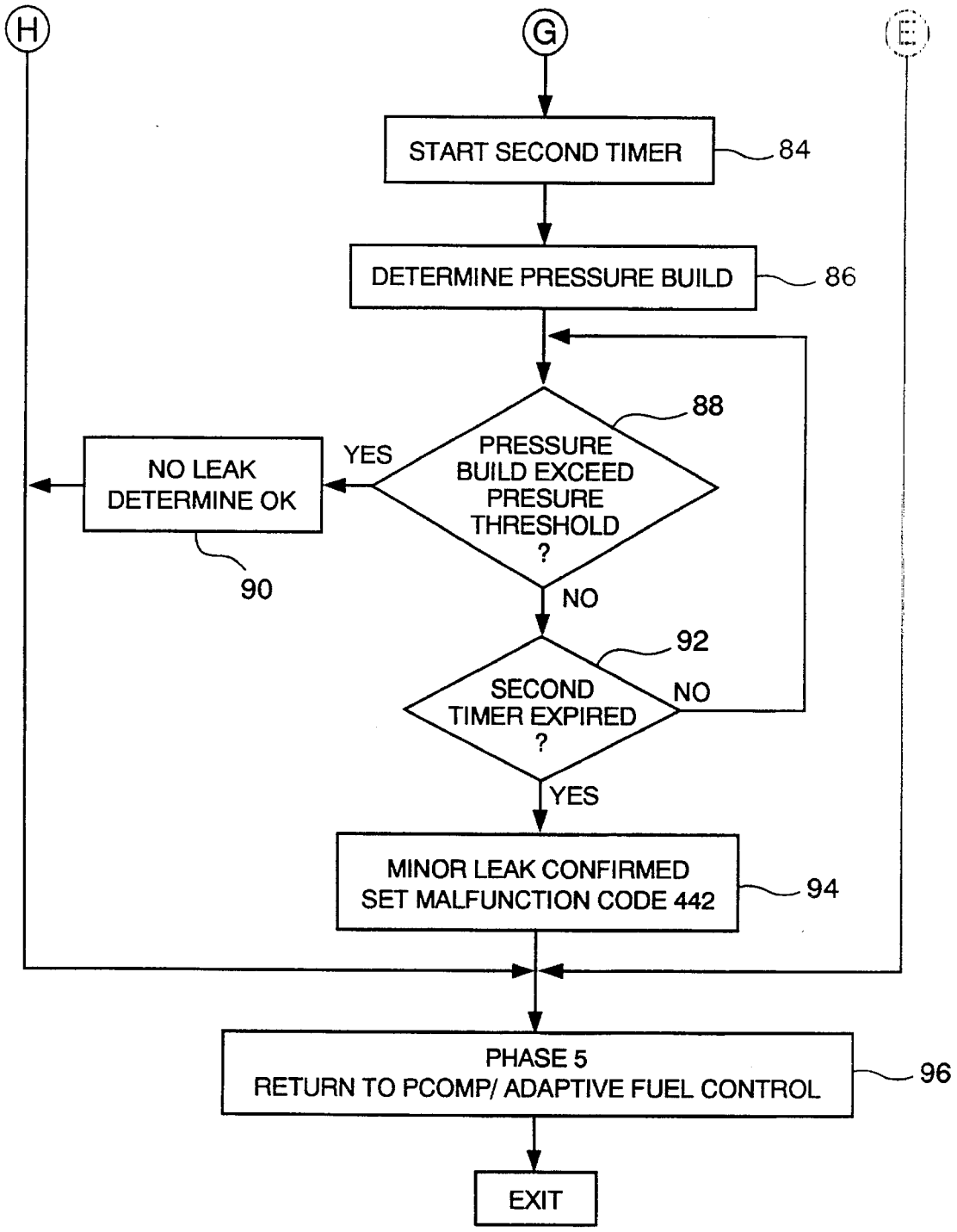

With reference to FIG. 1 of the drawings, there is provided a schematic diagram of the evaporative purge monitoring system of the present invention, designated generally by reference numeral 10. As shown, the system 10 includes a fuel tank 12, an internal combustion engine 14 and an evaporation canister 16 all in fluid communication, and an Electronic Engine Control (EEC) 17.

The fuel tank 12 provides fuel to the internal combustion engine 14 and typically includes a running loss vapor control valve 18 and a rollover valve 20. The fuel tank 12 may also include a vacuum relief valve 22, integral with the fuel tank cap, for preventing excessive vacuum or pressure from being applied to the fuel tank 12. The fuel tank 12 further includes a pressure transducer 24 for monitoring fuel tank pressure or vacuum and for providing an input to the EEC 17. The pressure transducer 24 may be installed directly into the fuel tank 12 (as shown in FIG. 1) or remotely mounted and connected by a line (not shown) to the fuel tank 12.

The evaporation canister 16 is provided for trapping and subsequently using fuel vapor dispelled from the fuel tank 12. The evaporation canister 16 is connected to atmosphere through a Canister Vent Valve (CVV) 26. A filter 28 may be provided between the CVV 26 and atmosphere for filtering the air pulled into the evaporation canister 16. The CVV 26 comprises a normally open solenoid controlled by the EEC 17 via an electrical connection to the CVV 26.

A Vapor Management Valve (VMV) 30 is interposed between the intake manifold (not shown) of the engine 14 and the fuel tank 12 and the evaporation canister 16. The VMV 30 comprises a normally closed vacuum operated solenoid which is also energized by the EEC 17. When the VMV 30 opens, the vacuum of the intake manifold of the engine 14 draws fuel vapors from the evaporation canister 16 for combustion in the cylinders (not shown) of the engine 14. When the EEC 17 de-energizes the VMV 30, fuel vapors are stored in the evaporation canister 16.

The system 10 may include a service port 31 interposed between the VMV 30 and the fuel tank 12 and the evaporation canister 16. The service port 31 aids an operator performing diagnostics on the evaporative purge system 10 to identify a malfunction or a leak. An evaporative system pressurization tool may be coupled to the service port 31 so that the operator can isolate the fault in the system 10.

With reference now to the flow diagram of FIGS. 2*a*–2*d*, the method steps of the evaporative purge monitoring system of the present invention will now be described in detail. To ensure accurate readings, the monitoring system of the present invention is designed to be operable only when a plurality of entry conditions have been satisfied, as shown by conditional block 32. The method will begin if all of the following entry conditions are met: 1) fuel tank pressure is within a calibrated vacuum target window; 2) vapor level is moderate; 3) engine load is within a calibrated load window; 4) ambient air temperature is within a calibrated temperature window; 5) vehicle speed is within a calibrated speed window; 6) barometric pressure is equal to or exceeds a calibrated minimum value; 7) time since engine was running exceeds a calibrated minimum value; and 8) time since a cold start is less than a calibrated maximum value.

There are five test phases in the method of the present invention in addition to a pre-test phase. The pre-test phase, Phase 0, is a timed vacuum application phase, as shown by block 34. The method of the present invention is executed only if the evaporative purge system is active and there is typically a prevailing vacuum in the fuel tank 12, unless the fuel tank cap is off. First, an amount of vapor flow is determined, as shown by block 35. Preferably, the vapor flow is inferred based on the content of the fuel mixture, thereby eliminating the need for a sensor. Alternatively, the vapor flow may be directly sensed using an appropriate sensor such as a hydrocarbon sensor. The amount of vapor flow determined at the start of Phase 0 is used in determining an appropriate vacuum bleed-up acceptance threshold for an evaporative purge system with a 0 .040" leak. Rather than being a scalar, the vacuum bleed-up acceptance threshold takes the form of a function with its input being inferred, or sensed, vapor flow since vapor generation contributes to pressure rise.

Next, a fuel tank pressure is sensed, as shown by block 36. Pressure is inversely related to vacuum. Thus, as initial vacuum level obtained from the fuel tank pressure is determined and compared to a vacuum target window, or range, as shown by conditional block 38. If the vacuum is less than the vacuum target window resulting in the vacuum being too high, vacuum bleed-up is initiated by closing the VMV 30 and keeping the CVV 26 open, as shown by block 40. If the fuel tank pressure exceeds the vacuum target window, additional vacuum is applied by keeping the VMV 30 open and ramping the CVV 26 closed, as shown by block 42.

Once the vacuum target window is met, the VMV 30 and the CVV 26 are closed in order to seal the evaporative purge system from atmosphere, as shown by block 44. Again, the vacuum in the evaporative purge system is compared to the vacuum target window, as shown by conditional block 46. If the vacuum is still too low, a malfunction signal is generated indicating a leak in the evaporative purge system, as shown by block 48. The malfunction may be a result of one of the following: 1) a large leak, i.e., fuel tank cap is off; 2) a disconnected/kinked purge line; or 3) a VMV failed closed. Similarly, if the vacuum is still too high, a malfunction signal is generated indicating the VMV 30 is failed open, as shown by block 50.

If the target vacuum is now met, the method proceeds with Phase 1, as shown by block 52. Phase 1 is a vacuum stabilization phase. The vacuum is allowed to stabilize for a predetermined amount of time or until the fuel tank pressure, PGM_TANK_PRS, exceeds a predetermined pressure threshold, PGM_PS1_MAX, as shown by block 54. Once the vacuum has stabilized, a stabilized vacuum level is determined, as shown by block 56. The method then proceeds to Phase 2, as shown by block 58.

Phase 2 is a vacuum hold phase. The method proceeds to wait for a predetermined amount of time, e.g., 10 seconds, as shown by block 60. Next, a vacuum bleed-up is determined, as shown by block 62. The vacuum bleed-up corresponds to the rise in the vacuum level from the stabilized vacuum level after the predetermined amount of time.

The amount of pressure rise in Phase 2 is examined for an indication of a leak. Therefore, the vacuum bleed-up is compared to the vacuum bleed-up acceptance threshold, as shown by conditional block 64. As described above, the vacuum bleed-up acceptance threshold is determined based on the amount of vapor flow. Preferably, the vacuum bleed-up acceptance threshold is a function of the maximum vapor flow. The vacuum bleed-up acceptance threshold is empirically determined for each specific vehicle application.

Figure 3:
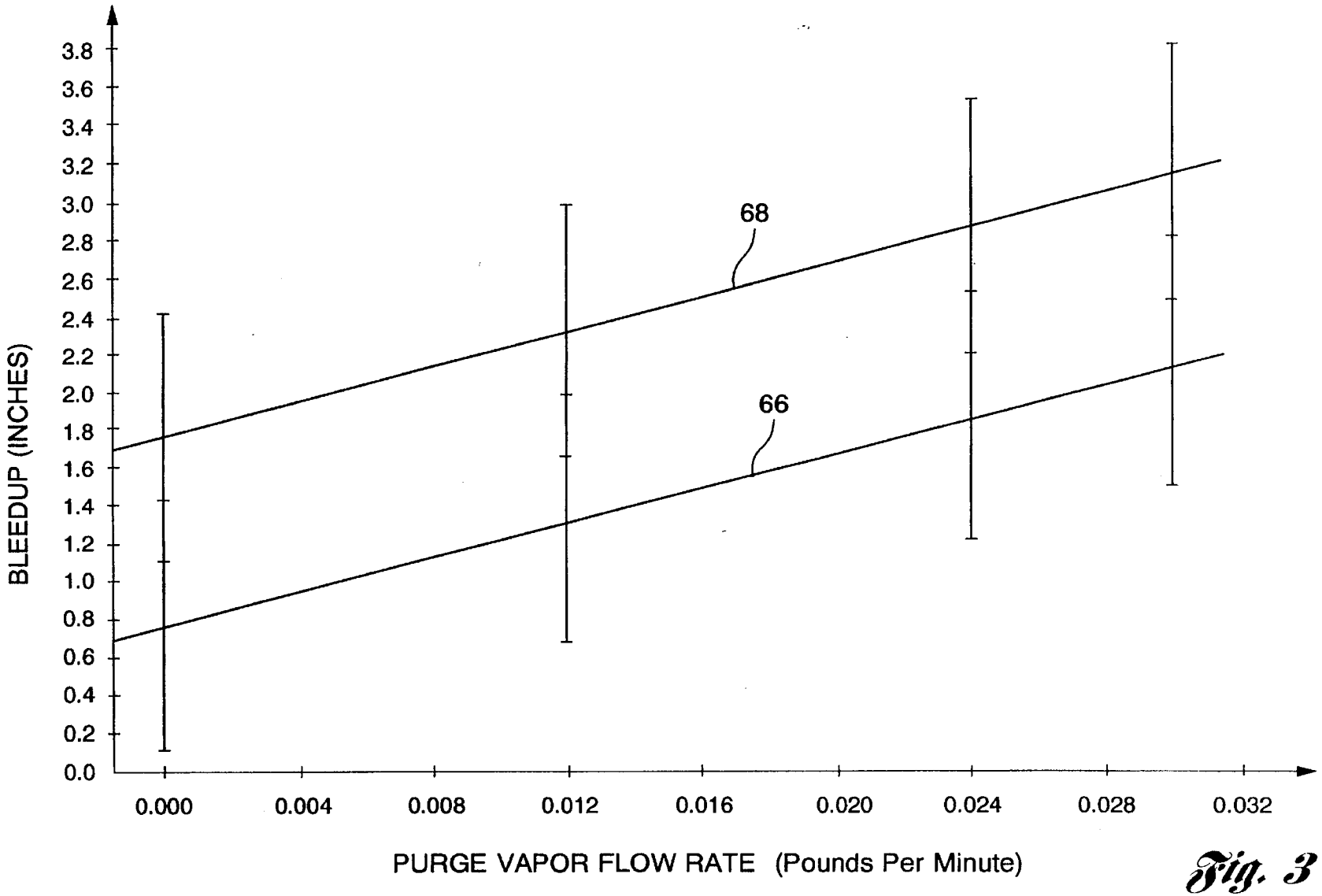
FIG. 3 is a graph illustrating vacuum bleed-up versus vapor flow for use in determining a vacuum bleed-up acceptance threshold.

Turning now to FIG. 3, there is shown a graph of vacuum bleed-up versus vapor flow in pounds per minute (PPM). Graph 66 illustrates the effect of vapor flow on vacuum bleed-up of a leak-free evaporative purge system. Although, the pressure is rising in the leak-free system, the pressure rise is due to the vapor flow. As the vapor flow increases, the threshold increases. Similarly, graph 68 illustrates the effect of vapor flow on vacuum bleed-up of an evaporative purge system having a 0.040" leak. Thus, the vacuum bleed-up acceptance threshold can be established for detecting a minor leak in the evaporative purge system utilizing vapor flow.

Returning to FIG. 2, if the vacuum bleed-up is less than the vacuum bleed-up acceptance threshold, the evaporative purge system is determined to be functioning properly without any leaks, as shown by block 70. If the vacuum bleed-up acceptance threshold is exceeded, the test is performed again if a retry counter has not expired, as shown by conditional block 72. Preferably, the test is run three times prior to proceeding to Phase 3.

If the retry counter has expired and the vacuum bleed-up acceptance threshold has been exceeded, the method proceeds to Phase 3 of the test, as shown by block 74. Phase 3 is a vacuum stabilization phase. The VMV 30 is kept closed and the CVV 26 is opened to atmosphere, as shown by block 76. The vacuum is allowed to stabilize at atmospheric pressure for a predetermined amount of time or until the fuel tank pressure, PGM_TANK_PRS, exceeds a predetermined target pressure threshold, PGM_PS3_TRG, as shown by block 78. The target pressure threshold is preferably approximately –½ inch.

The method then proceeds to Phase 4, as shown by block 80. Phase 4 is a vapor generation phase. While the VMV 30 is closed, the CVV 26 is closed, as shown by block 82. Any pressure build subsequently generated will be due to vapor generation, not to a leak in the evaporative purge system. A second timer is initiated, as shown by block 84. The pressure build is determined, as shown by block 86, and compared to a pressure threshold, e.g., 2-inches, as shown by conditional block 88. The pressure threshold may be absolute or relative to the target pressure threshold.

If the pressure build exceeds the pressure threshold, the evaporative purge system is determined to be functioning properly, as shown by block 90, since the pressure build is caused by vapor generation and not by leaks in the system. If the pressure threshold is not exceeded, the method continues to compare the pressure build with the pressure threshold until the second timer expires, as shown by conditional block 92.

If the second timer has expired, e.g., 100 seconds have elapsed since initiation of Phase 4, a leak in the evaporative purge system is determined and a malfunction signal is generated, as shown by block 94. If desired, a malfunction warning/light can be displayed illuminated for the driver of the vehicle to see. Preferably, the malfunction signal is provided to the driver of the vehicle after at least two malfunction signals are generated. For a more accurate indication of a malfunction and to minimize the likelihood of a false error indication, the malfunction is not provided to the driver unless at least two, preferably, three, malfunction signals are generated in successive trips.

Phase 5 is the end of the test. This final phase of the test returns the purge system to normal engine purge, as shown by block 96. The CVV 26 is opened at a calibrated ramp rate to the full open position. The engine control system is allowed to return to either purge or adaptive fuel learning, whichever the engine strategy is requesting at the present time.

The method includes early exit or abort conditions. Over the duration of the test, several occurrences are possible that may require the early termination of the test. These occurrences are those that would, in high probability, result in a false malfunction signal. These abort conditions include: 1) operation out of engine load window; 2) operation out of vehicle speed window; 3) operation out of engine load variability window; 4) loss of closed loop fuel control; and 5) excessive fuel vapor pressure fluctuation. The test will be aborted if any of the abort conditions are met after the test is begun.

Figure 4:
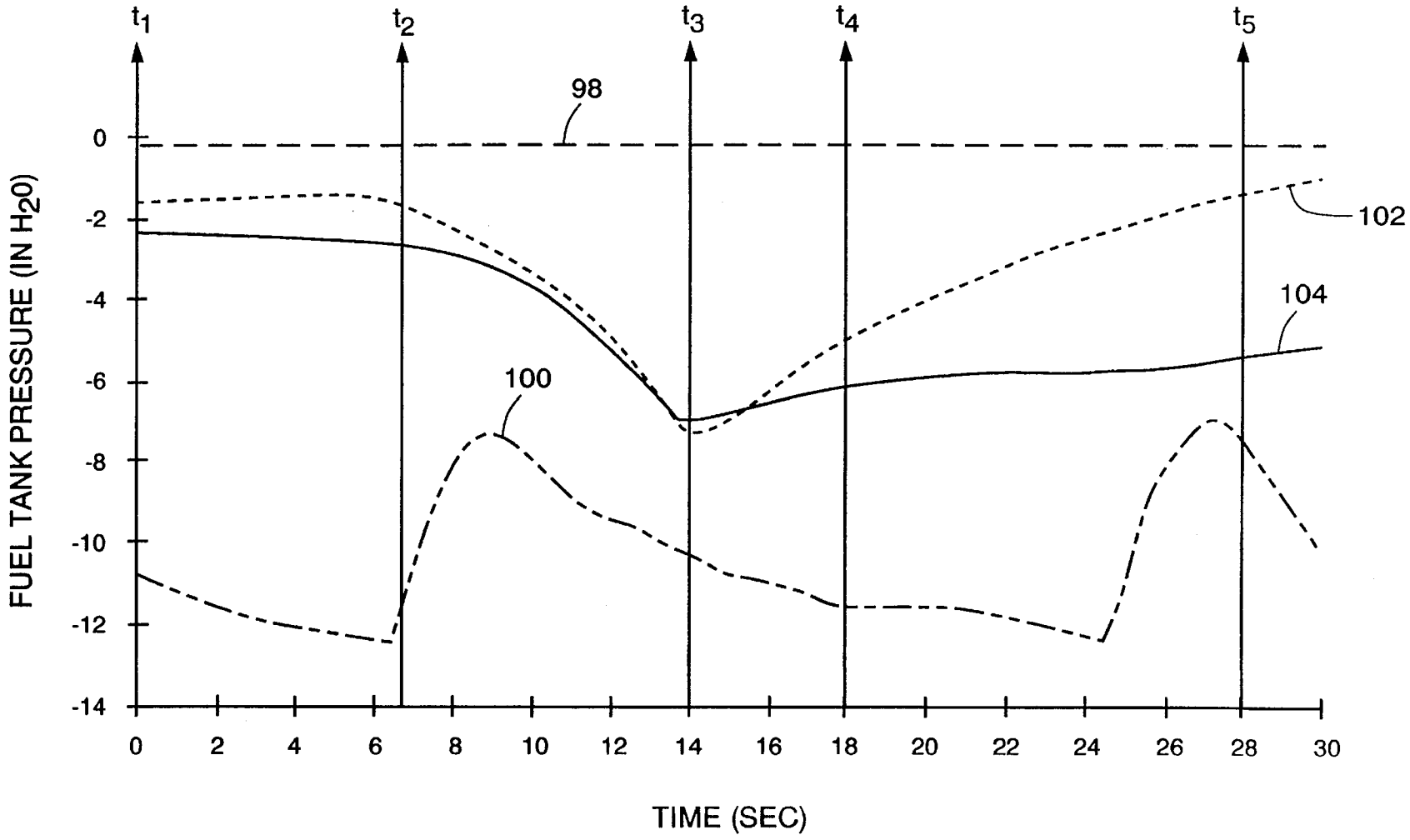
FIG. 4 is a graphical representation of four possible outcomes when performing the method steps of the present invention.

Turning now to FIG. 4, there is shown a graphical representation of four possible outcomes when performing the method steps of the present invention. Time period $t_1$ corresponds to Phase 0 in which the fuel tank pressure is sensed. Time period $t_2$ corresponds to the vacuum application stage of Phase 0 if the fuel tank pressure is not within the predetermined vacuum target window. Vacuum is applied at time period $t_2$, if necessary.

After time period $t_2$ but before time period $t_3$, the VMV 30 and the CVV 26 are closed and the vacuum level is again compared to the predetermined vacuum target range. If there is not enough vacuum, as shown by graph 98, a gross leak is detected and a corresponding malfunction code is generated. This gross leak occurs because the VMV 30 cannot pull a vacuum due to the VMV 30 being failed in a closed position or disconnected, the gas cap being off or a hose having a kink. If there is excessive vacuum, as shown by graph 100, a corresponding malfunction code is generated. The VMV 30 is determined to be failed in the open position and a corresponding malfunction code is generated. The fluctuation in vacuum is caused by a constant vacuum being applied by the VMV 30 and the hysteresis of the vacuum relief valve 22 in the fuel tank cap as it is being activated.

Time period $t_3$ corresponds to Phase 1 of the test. The vacuum is allowed to stabilize until time period $t_4$. At time period $t_4$, a first vacuum level is recorded corresponding to the stabilized vacuum level. Time period $t_4$ also corresponds to the beginning of Phase 2. The vacuum is held for a predetermined amount of time, e.g., 10 seconds, and a second vacuum level corresponding to the vacuum bleed-up is recorded at time period $t_5$. If the vacuum bleed-up acceptance threshold is exceeded, as shown by graph 102, a corresponding malfunction code is generated indicating a small leak in the fuel tank 12, a hose, or the CVV 26. If the vacuum bleed-up acceptance threshold is not exceeded, as shown by graph 104, the evaporative purge system 10 is determined to be functioning properly.

While the best modes for carrying out the invention have been described in detail, those familiar with the art to which this invention relates will recognize various alternative designs and embodiments for practicing the invention as defined by the following claims.

What is claimed is:

1. For use with a vehicle having an evaporative purge system including a fuel tank, an evaporation canister for trapping and subsequently using vapor dispelled from the fuel tank, and an internal combustion engine having an intake manifold all in fluid communication, a method for monitoring the evaporative purge system for malfunctions and leaks, the method comprising:

(a) determining whether a plurality of predetermined entry conditions have been met;

(b) if the plurality of predetermined entry conditions have been met, determining a flow of vapor in the evaporative purge system;

(c) sealing the evaporative purge system from atmosphere so as to pull a vacuum on the fuel tank;

(d) determining whether the vacuum is within a predetermined vacuum range;

(e) if the vacuum is within the predetermined vacuum range, allowing the vacuum to stabilize to obtain a stabilized vacuum level;

(f) determining a rise in the stabilized vacuum level after a predetermined amount of time to obtain a vacuum bleed-up;

(g) determining a vacuum bleed-up acceptance threshold based on the determined flow of vapor;

(h) comparing the vacuum bleed-up with the vacuum bleed-up acceptance threshold;

(i) providing atmosphere to the evaporative purge system if the vacuum bleed-up exceeds the vacuum bleed-up acceptance threshold;

(j) sealing the evaporative purge system from atmosphere to create a pressure build;

(k) comparing the pressure build to a pressure threshold; and (l) generating a first malfunction signal if the pressure build is less than the pressure threshold.

2. The method as recited in claim 1 wherein the step of determining the vacuum bleed-up acceptance threshold includes the step of detecting a peak flow of vapor.

3. The method as recited in claim 1 further comprising:

generating a second malfunction signal if the vacuum is less than the predetermined vacuum range; and generating a third malfunction signal if the vacuum exceeds the predetermined vacuum range.

4. The method as recited in claim 3 further comprising the step of displaying one of the first, second and third malfunction signals to an operator of the vehicle.

5. The method as recited in claim 4 wherein the step of displaying the one of the first, second and third malfunction signals to the operator is performed after at least two corresponding malfunction signals are generated in successive trips.

6. The method as recited in claim 1 wherein steps (a)–(h) are repeated at least once prior to step (i).

7. The method as recited in claim 1 further comprising the step of determining an initial vacuum in the evaporative purge system prior to step (c).

8. The method as recited in claim 7 further comprising:

comparing the initial vacuum to the predetermined vacuum range;

applying additional vacuum to the evaporative purge system if the initial vacuum is less than the predetermined vacuum range; and dissipating vacuum from the evaporative purge system if the initial vacuum exceeds the predetermined vacuum range.

9. The method as recited in claim 1 wherein the step of allowing the vacuum to stabilize includes the step of determining whether a predetermined amount of time has elapsed or the pressure exceeds a predetermined pressure threshold.

10. The method as recited in claim 1 further comprising the step of determining whether one of a plurality of abort conditions have been met.

11. For use with a vehicle having an evaporative purge system including a fuel tank, an evaporation canister for trapping and subsequently using vapor dispelled from the fuel tank, and an internal combustion engine having an intake manifold all in fluid communication, a system for monitoring the evaporative purge system for malfunctions and leaks, the system comprising:

a vapor management valve interposed between the intake manifold of the internal combustion engine, the fuel tank and the evaporation canister for pulling a vacuum on the fuel tank and the evaporation canister;

a canister vent valve interposed between atmosphere and the evaporation canister for sealing the evaporative purge system from atmosphere;

a pressure transducer coupled to the fuel tank for sensing the vacuum in the fuel tank; and an electronic engine control (EEC) assembly, in electrical communication with the vapor management valve, the canister vent valve and the pressure transducer, for performing the following:

determining whether a plurality of predetermined entry conditions have been met;

determining a flow of vapor in the evaporative purge system;

determining whether the sensed vacuum is within a predetermined vacuum range;

allowing the sensed vacuum to stabilize to obtain a stabilized vacuum level;

determining a rise in the stabilized vacuum level after a predetermined amount of time to obtain a vacuum bleed-up;

determining a vacuum bleed-up acceptance threshold based on the determined flow of vapor;

comparing the vacuum bleed-up with the vacuum bleed-up acceptance threshold;

determining a pressure build if the vacuum bleed-up exceeds the vacuum bleed-up acceptance threshold;

comparing the pressure build to a pressure threshold; and generating a first malfunction signal if the pressure build is less than the threshold.

12. The system as recited in claim 11 wherein the EEC assembly is further provided for detecting a peak flow of vapor based on the determined flow of vapor.

13. The system as recited in claim 11 wherein the EEC assembly is further provided for:

generating a second malfunction signal if the sensed vacuum is less than the predetermined vacuum range; and generating a third malfunction signal if the sensed vacuum exceeds the predetermined vacuum range.

14. The system as recited in claim 13 further comprising a display for displaying one of the first, second and third malfunction signals to an operator of the vehicle.

15. The system as recited in claim 14 wherein the one of the first, second and third malfunction signals is displayed to the operator after at least two corresponding malfunction signals are generated in successive trips.

16. The system as recited in claim 11 wherein the EEC assembly is further provided for determining an initial vacuum in the evaporative purge system prior to sealing the evaporative purge system.

17. The system as recited in claim 16 wherein the EEC assembly is further provided for:

comparing the initial vacuum to the predetermined vacuum range; and causing additional vacuum to be applied to the evaporative purge system if the initial vacuum is less than the predetermined vacuum range; and causing vacuum to be dissipated from the evaporative purge system if the initial vacuum exceeds the predetermined vacuum range.

18. The system as recited in claim 11 wherein the EEC assembly is further provided for determining whether a predetermined amount of time has elapsed or whether the pressure exceeds a predetermined pressure threshold.

19. The system as recited in claim 11 wherein the EEC assembly is further provided for determining whether one of a plurality of abort conditions have been met.

* * * * *